US010451050B2

(12) United States Patent
Thackery et al.

(10) Patent No.: US 10,451,050 B2
(45) Date of Patent: Oct. 22, 2019

(54) CORD MANAGEMENT SYSTEM FOR A PORTABLE AIR COMPRESSOR

(71) Applicant: TTI (Macao Commercial Offshore) Limited, Macau (MO)

(72) Inventors: Clinton C. Thackery, Clemson, SC (US); Christopher Scott Tennant, Clemson, SC (US); Kenneth Brazell, Piedmont, SC (US)

(73) Assignee: TTI (MACAO COMMERCIAL OFFSHORE) LIMITED, Macau (MO)

( * ) Notice: Subject to any disclaimer, the term of this patent is extended or adjusted under 35 U.S.C. 154(b) by 0 days.

(21) Appl. No.: 15/358,879

(22) Filed: Nov. 22, 2016

(65) Prior Publication Data

US 2017/0146002 A1 May 25, 2017

Related U.S. Application Data

(60) Provisional application No. 62/258,927, filed on Nov. 23, 2015.

(51) Int. Cl.
*F04B 41/02* (2006.01)
*F04B 35/04* (2006.01)
(Continued)

(52) U.S. Cl.
CPC ..... *F04B 41/02* (2013.01); *F04B 35/04* (2013.01); *F04B 35/06* (2013.01); *F04B 39/121* (2013.01);
(Continued)

(58) Field of Classification Search
CPC ..... F04B 35/06; F04B 39/121
See application file for complete search history.

(56) References Cited

U.S. PATENT DOCUMENTS

D307,017 S 4/1990 Polk et al.
6,912,865 B2 * 7/2005 Seo ..... F16F 1/3732 181/207
(Continued)

FOREIGN PATENT DOCUMENTS

CN 200949508 Y 9/2007
CN 201165962 Y 12/2008
(Continued)

OTHER PUBLICATIONS

United States Patent Office Action for U.S. Appl. No. 29/551,600 dated Feb. 7, 2018 (8 pages).
(Continued)

*Primary Examiner* — Jessica Cahill
*Assistant Examiner* — Angelisa L Hicks
(74) *Attorney, Agent, or Firm* — Michael Best & Friedrich LLP

(57) ABSTRACT

A portable air compressor including an air tank configured to store compressed air. The portable air compressor further includes a compressor unit coupled to the air tank including compressor components for compressing air, and a housing having a base disposed generally between the compressor components and the air tank. The base has a concave recess extending at least partially around a circumference of the compressor unit. The portable air compressor further includes a power cord for supplying power to the compressor components. The power cord is receivable around the circumference of the compressor unit in the recess for storage.

25 Claims, 5 Drawing Sheets

(51) Int. Cl.

| | |
|---|---|
| ***F04B 35/06*** | (2006.01) |
| ***F04C 29/00*** | (2006.01) |
| ***F04C 18/16*** | (2006.01) |
| ***F04C 18/34*** | (2006.01) |
| ***F04B 39/12*** | (2006.01) |

(52) U.S. Cl.

CPC ..... *F04C 18/16* (2013.01); *F04C 18/34* (2013.01); *F04C 29/0085* (2013.01)

(56) References Cited

U.S. PATENT DOCUMENTS

| | | | | |
|---|---|---|---|---|
| 7,406,874 | B2 * | 8/2008 | Carnal | G01N 17/04 73/706 |
| D588,612 | S * | 3/2009 | Steinfels | D15/7 |
| 8,146,622 | B2 * | 4/2012 | Guan | B29C 73/166 141/114 |
| D667,467 | S | 9/2012 | Kosugi et al. | |
| 8,727,741 | B2 | 5/2014 | Nutz et al. | |
| D711,926 | S | 8/2014 | Tatic | |
| D718,790 | S | 12/2014 | Yang | |
| 9,004,117 | B2 | 4/2015 | Stansbury et al. | |
| D744,006 | S | 11/2015 | Nommensen | |
| D792,472 | S | 7/2017 | Kirkpatrick et al. | |
| D792,473 | S | 7/2017 | Imsand et al. | |
| 2004/0096341 | A1 * | 5/2004 | Hung | F04B 35/06 417/363 |
| 2006/0104830 | A1 * | 5/2006 | Fields | F04B 41/02 417/360 |
| 2011/0130031 | A1 * | 6/2011 | Kartes | H01R 13/465 439/501 |

FOREIGN PATENT DOCUMENTS

| | | | |
|---|---|---|---|
| CN | 101372197 | A | 2/2009 |
| JP | 2011236858 | A | 11/2011 |
| WO | 2010042597 | | 4/2010 |

OTHER PUBLICATIONS

Chinese Patent Office Action for Application No. 201611032176.0 dated Jan. 28, 2019, 10 pages.

* cited by examiner

CORD MANAGEMENT SYSTEM FOR A PORTABLE AIR COMPRESSOR

RELATED APPLICATION

The present application claims priority to U.S. Provisional Patent Application No. 62/258,927, filed Nov. 23, 2015, the entire contents of which are hereby incorporated by reference.

BACKGROUND

The present invention relates to air compressors and, more particularly, to portable air compressors. Air compressors include compressor units for compressing air and storage tanks for storing the compressed air for later use. Air compressors are often used at work sites, for example to power pneumatically-operated tools. Currently used air compressors are often large, heavy, bulky, and difficult to transport by hand.

SUMMARY

In one aspect, the invention provides a portable air compressor. The portable air compressor includes an air tank configured to store compressed air. The portable air compressor includes a compressor unit coupled to the air tank including compressor components for compressing air, and a housing having a base disposed generally between the compressor components and the air tank. The base has a concave recess extending at least partially around a circumference of the compressor unit. The portable air compressor includes a power cord for supplying power to the compressor components. The power cord is receivable around the circumference of the compressor unit in the recess for storage.

In another aspect, the invention provides a portable air compressor. The portable air compressor includes an air tank configured to store compressed air. The portable air compressor includes a compressor unit in fluid communication with the air tank and including a housing having a concave recess extending at least partially around a circumference of the compressor unit. The housing further includes compressor components for compressing air for storage in the air tank. The compressor components are stored in the housing. The portable air compressor further includes a power cord for supplying power to the compressor components. The power cord is receivable around the circumference of the compressor unit in the recess for storage.

In yet another aspect, the invention provides a portable air compressor. The portable air compressor includes an air tank having a curved tank surface for storing compressed air and compressor components in fluid communication with the air tank for providing compressed air to the air tank. The portable air compressor includes a housing for storing the compressor components and engageable with the air tank. The housing includes a base having a contact surface shaped to complement the curved tank surface of the air tank, and a recess formed about a circumference of the housing. The portable air compressor includes a power cord for supplying power to the compressor components. The power cord is receivable in the recess for storage.

Other aspects of the invention will become apparent by consideration of the detailed description and accompanying drawings.

Before any constructions of the invention are explained in detail, it is to be understood that the invention is not limited in its application to the details of construction and the arrangement of components set forth in the following description or illustrated in the following drawings. The invention is capable of other constructions and of being practiced or of being carried out in various ways. Also, it is to be understood that the phraseology and terminology used herein are for the purpose of description and should not be regarded as limiting.

DETAILED DESCRIPTION

FIGS. 1-6 illustrate an air compressor 10 according to one construction of the invention. The illustrated air compressor 10 is a portable air compressor that is transportable between worksites (e.g., construction sites, garages, etc.). The air compressor 10 provides a source of compressed air for performing various tasks such as operating pneumatic power tools, filling vehicle tires, or the like. In the illustrated construction, the air compressor 10 is designed as a relatively compact unit that is movable around a worksite by a single user.

Figure 1:
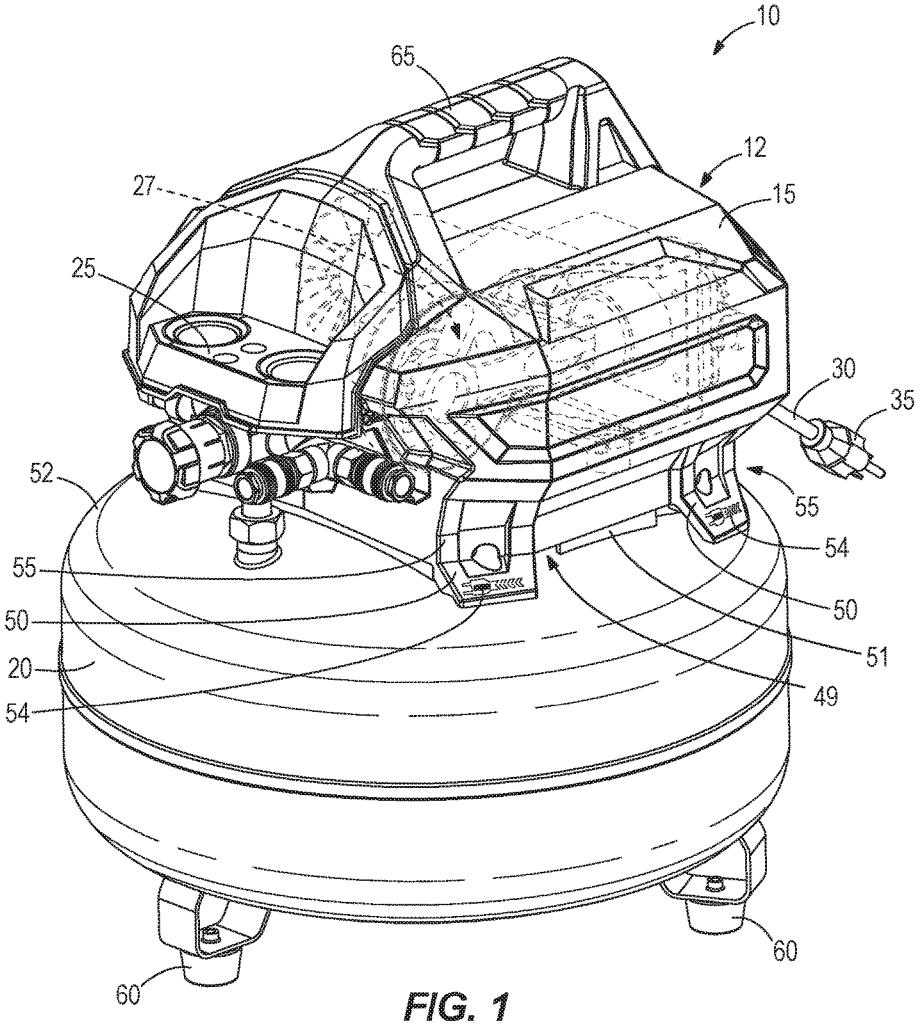
FIG. 1 is a front perspective view of a portable air compressor having an air tank and a compressor unit according to one construction of the invention.
Figure 2:
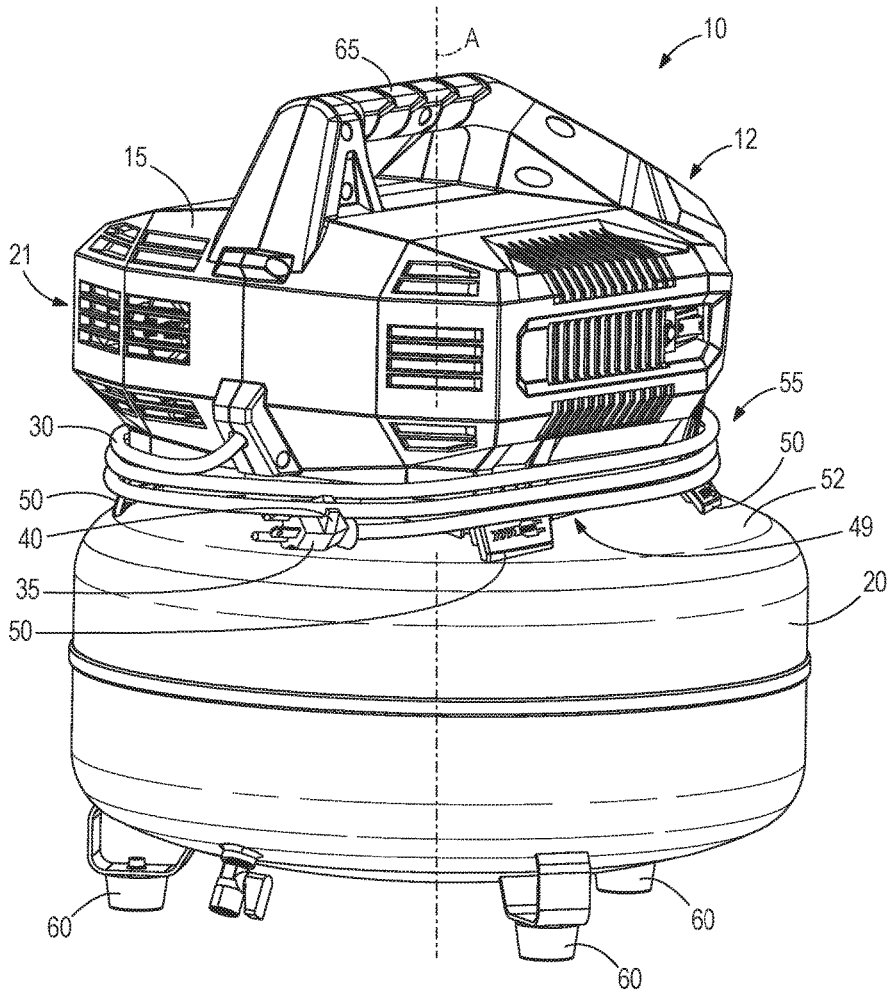
FIG. 2 is rear perspective view of the portable air compressor shown in FIG. 1.
Figure 3:
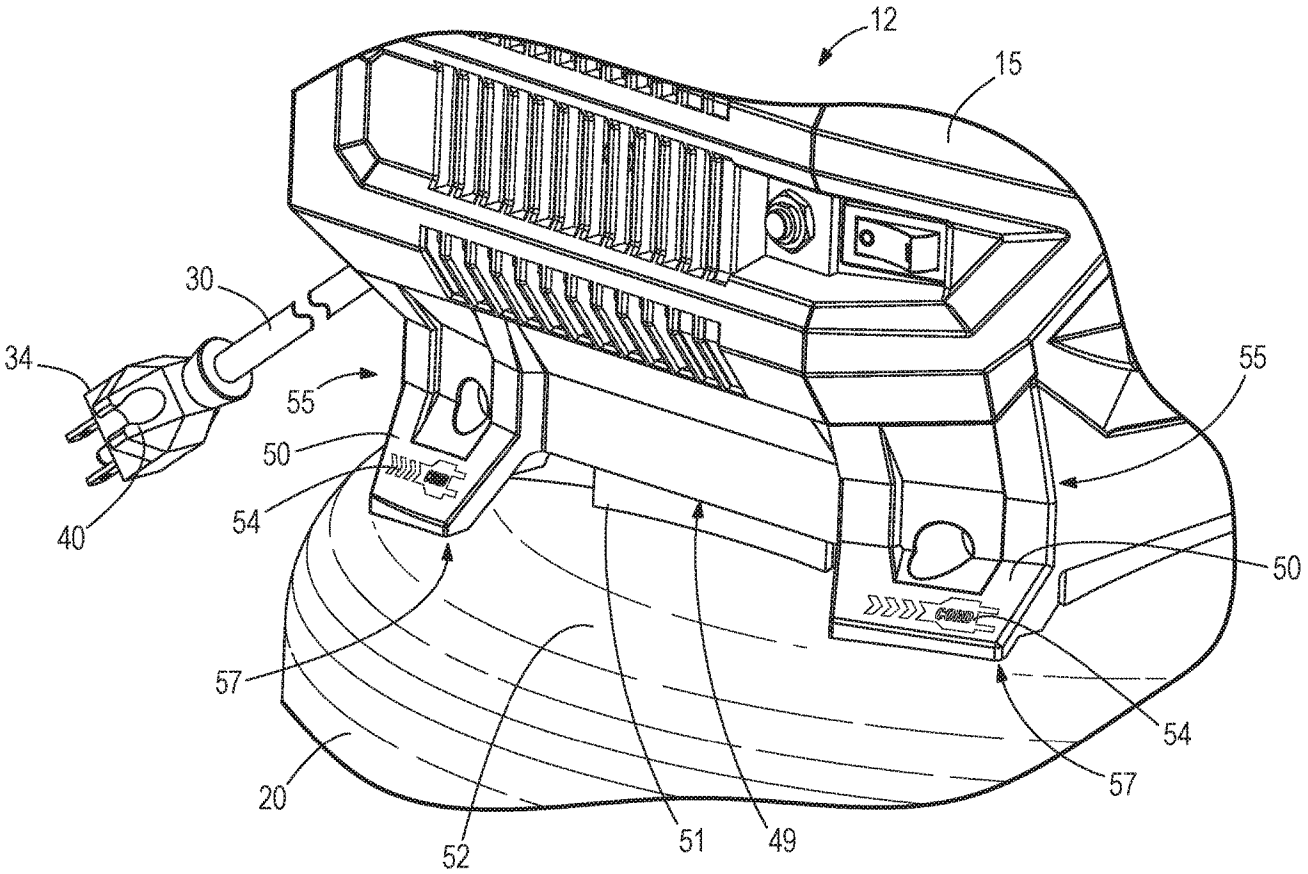
FIG. 3 is a detail view of a front foot and a rear foot of the portable air compressor shown in FIG. 1.
Figure 4:
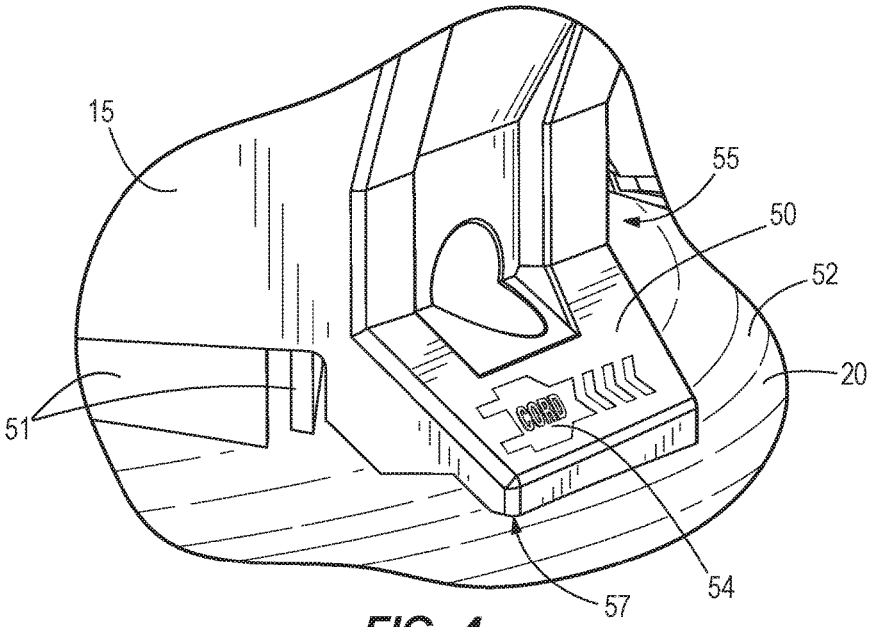
FIG. 4 is a detail view of the front foot of the air compressor shown in FIG. 3.
Figure 5:
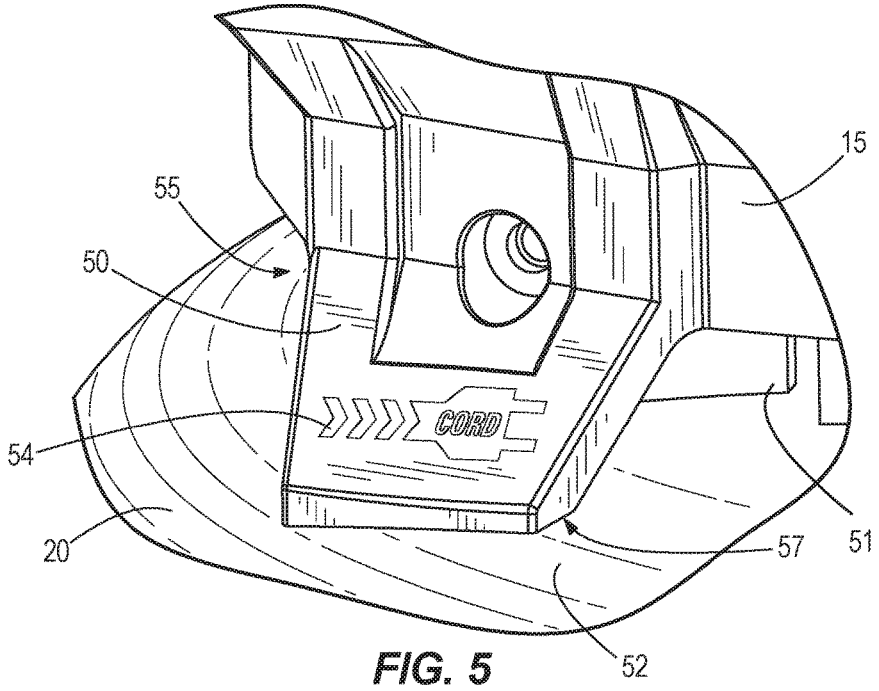
FIG. 5 is a detail view of the rear foot of the air compressor shown in FIG. 3.

Referring to FIGS. 1-2, the portable air compressor 10 includes an air tank 20 for storing and dispensing compressed air or other fluid. The illustrated air tank 20 has a generally flattened shape with a circular cross-section, such as a generally flattened cylindrical shape, a flattened spherical or torso spherical shape, etc. (e.g., a "pancake" style air tank). The air tank 20 may have other shapes in other constructions, such as elongated cylindrical, round, spherical, etc. The air tank may include supports 60 extending from the air tank for at least partially supporting the air compressor on a support surface, e.g., the ground or floor.

Figure 6:
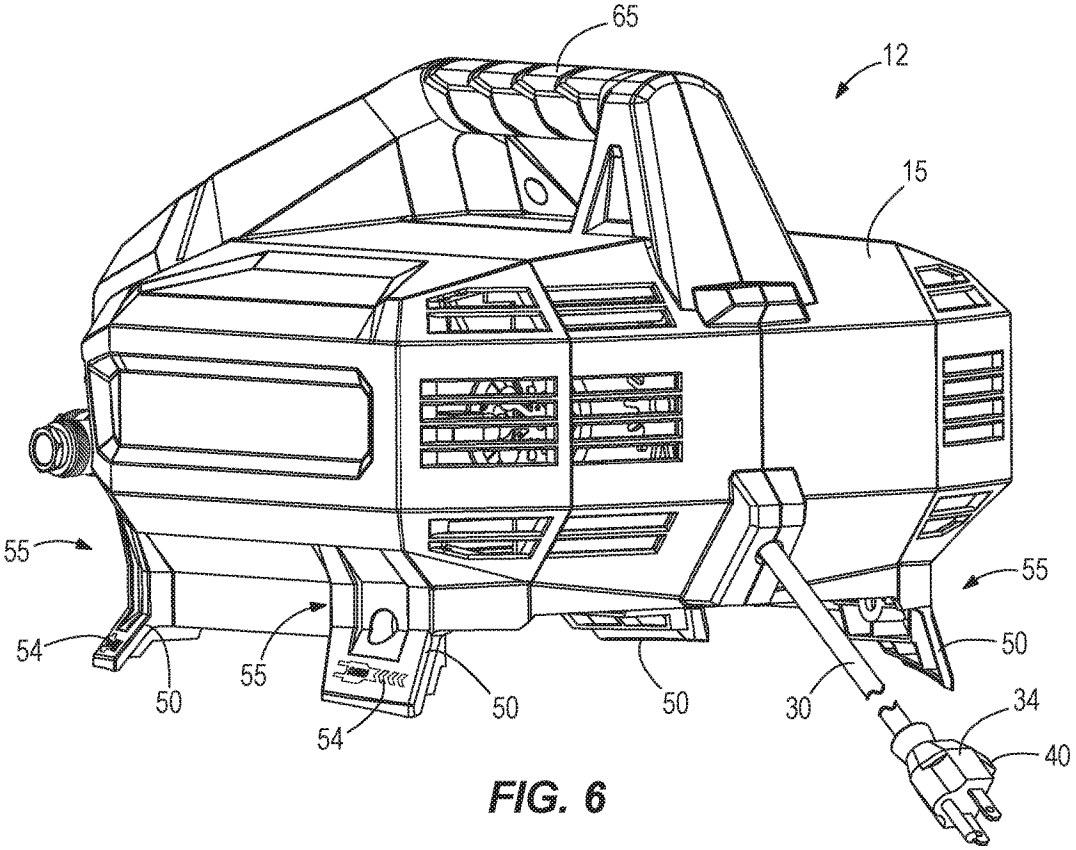
FIG. 6 is a rear perspective view of the compressor unit shown in FIG. 1.

Referring to FIGS. 1-2 and 6, the portable air compressor 10 includes a compressor unit 12. The compressor unit 12 is fluidly and mechanically coupled to the air tank 20. The compressor unit 12 includes a housing 15, a control assembly 25 (FIG. 1), and compressor components 27 (FIG. 1) supported inside the housing 15 for compressing the air. An example of the illustrated compressor components 27 include such as a motor/compressor assembly, whereby the motor drives the compressor. In some constructions, the compressor may be, for example, a reciprocating compressor, a rotary screw compressor, a rotary vane compressor, or the like. In other constructions, other suitable compressors may be employed. In the illustrated construction, the motor is an electric motor (e.g., an AC motor), but may be another type of motor in other constructions.

A power cord 30 extends from the housing 15 of the compressor unit 12 and electrically connects the compressor components 27 to a source of power for powering the motor to drive the compressor. The power cord 30 may be any length. For example, the power cord 30 may be about 3 feet or longer, such as about 6 feet long. The power cord 30 includes a plug 35, and the plug 35 includes a connector 40, such as a generally U-shaped or C-shaped prong, or clip, for coupling to an intermediate portion of the power cord 30 for storage.

The control assembly 25 is supported by the housing 15 and positioned to be readily visible and accessible by the user for adjusting the output pressure from the air tank 20 for different applications (e.g., for pneumatic power tools requiring different operating pressures) and may include one or more pressure display gauges. The housing 15 also includes a handle 65 for a user to grasp and move the air compressor 10 and/or the compressor unit 12.

As shown in detail in FIGS. 3-6, the housing 15 is supported on the air tank 20 by a base 49 extending from the housing 15 and disposed generally between the compressor components 27 and the air tank 20. In the illustrated construction, the base 49 includes four feet 50, but one, two, three, five or more feet may be employed in other constructions. In yet other constructions, the base 49 may be a single continuous piece extending from the housing 15 (e.g., a generally circumferential base) or may be embodied as two or more rails extending from the housing 15 (e.g., extending along opposite sides of the bottom of the housing 15). The base 49 is arranged generally around a bottom side of the compressor unit 15 that generally faces the air tank 20 and includes a concavity 55, or recess (e.g., a concave recess), for receiving the power cord 30 wrapped around an outer circumference of the base 49. An air hose (not shown) may also be wrapped around the concavity 55. The concavity 55 extends at least partially around the circumference of the housing 15 (e.g., around the base 49), which should be understood to mean that the concavity 55 may be continuous around the housing 15 (e.g., forming a generally circular concave recess around the housing 15) or may include multiple discrete portions around the housing 15 collectively forming the concavity 55 (e.g., as illustrated in FIGS. 1-6 where the recess is formed collectively by the feet 50 arranged generally about the circumference of the compressor unit 12). Preferably, the concavity 55 includes at least three or more discrete portions arranged circumferentially around the compressor unit 12. In the illustrated construction, the concavity is generally coaxial with a central axis A (FIG. 2) of the air tank 20 such that the cord 30 may be wrapped generally around the central axis A.

In other constructions, the concavity 55 may be positioned anywhere on the housing 15. For example, the concavity 55 may be disposed in an outer circumferential area 21 (FIG. 2), or perimeter, of the housing 15, such as above the base 49, for receiving the cord 30 and/or the air hose (not shown) wrapped therearound. As such, the concavity 55 may be spaced from the base 49. In other constructions, the concavity 55 may have other orientations about the housing 15. Furthermore, the housing 15 includes indicia 54, such as a symbol or image of a cord and/or a hose, text indicative or a cord and/or a hose, etc., to indicate to an operator that the power cord 30 and/or the air hose (not shown) may be wrapped around the outer circumference of the base 49. The indicia 54 may be disposed on or near the concavity 55.

In some constructions, the base 49 engages the air tank 20 in a manner such that the feet 50 are pre-loaded against the air tank 20 to reduce vibrations between the air tank 20 and the compressor unit 12. In such constructions, the compressor unit 12 is secured to the air tank 20 by way of a bracket 51 tight enough to hold the compressor unit 12 in the pre-loaded condition against the air tank 20. In other constructions, the base 49 may be spaced from the air tank 20 to define a gap (not shown) between the base 49 and the air tank 20. The gap (not shown) would have a width smaller than a diameter of the power cord 30 to prevent the power cord 30 from slipping between the base 49, or feet 50, and the air tank 20.

In the illustrated construction, the base 49 (e.g., each foot 50) includes a contact surface 57 (FIGS. 4-5) engaging the air tank 20 and shaped to complement a contour of a tank surface 52 of the air tank 20. Thus, in the illustrated construction, the contact surface 57 is non-planar and has a curvature that generally follows the tank surface 52 engaged therewith.

The base 49 is preferably formed from a flexible or elastic material, such as a polymeric material, which allows the base 49 to be pre-loaded against the air tank 20. For example, the base 49 may be formed from polypropylene. In some constructions, the base 49 may be formed of other suitable material, such as rubber or the like. The base 49 may be formed from a separate material, or the same material, as a remainder of the housing 15.

In operation, the user wraps the power cord 30 and/or the compressed air hose around the base 49, e.g., the feet 50, of the compressor unit 12 for storage as illustrated in FIG. 2. If the power cord 30 is about 6 feet long, the power cord 30 may wrap around the feet 50 at the base about 2 to 3 times. Additionally, the user may clip the plug 35 to the power cord 30 by way of the connector 40 to stow the loose end of the power cord 30 securely.

When the compressor unit 12 and the air tank 20 are coupled, the base 49 supports the compressor unit 12 on the air tank 20. The flexibility of the base 49 allows the base 49, e.g., the feet 50, to flex and/or expand outwards when coupled to the air tank 20 so that the base 49 is preloaded to dampen vibrations and increase stability of the housing 15 when the air compressor 10 is in use. Furthermore, this flexion of the base 49 provides a substantially gapless connection to the air tank 20 such that the power cord 30 is inhibited from getting stuck in a gap or stuck between the compressor unit 12 and the air tank 20, thus facilitating ease of storage. Also, the need for dedicated cord-storage prongs extending from the housing 12 or the tank 20 is avoided.

Although the invention has been described in detail with reference to certain preferred constructions, variations and modifications exist within the scope and spirit of one or more independent aspects of the invention as described.

What is claimed is:

1. A portable air compressor comprising:

an air tank configured to store compressed air;

a compressor unit securely coupled to the air tank by a bracket, the compressor unit including compressor components, including a motor and a compressor, for compressing air, a housing defining a chamber in which the compressor components are disposed, the housing having a first side and a second side, the first side being opposite the second side, the housing having a base disposed on the first side, the base disposed generally between the compressor components and the air tank, the base having a concave recess extending at least partially around a circumference of the compressor unit, wherein the housing further includes a contact surface engaging the air tank and shaped to complement a surface of the air tank, wherein the housing is pre-loaded in flexion against the air tank, and a handle extending from the second side of the housing in a direction generally opposite the base, wherein the housing defines an axis extending generally from the first side to the second side, wherein the recess recedes toward the axis; and a power cord for supplying power to the compressor components, the power cord receivable generally circumferentially around the axis and around the circumference of the compressor unit in the recess for storage.

2. The portable air compressor of claim 1, wherein the base includes a plurality of feet.

3. The portable air compressor of claim 2, wherein the plurality of feet are spaced generally around a circumference of the compressor unit, and wherein the recess is formed collectively in the plurality of feet generally around the circumference.

4. The portable air compressor of claim 2, wherein the base is continuously circumferential, and wherein the recess extends around the circumference of the compressor unit.

5. The portable air compressor of claim 1, wherein the base is formed from a flexible polymeric material.

6. The portable air compressor of claim 1, wherein the surface of the air tank includes a curved tank surface, and wherein the base includes the contact surface engaging the air tank shaped to complement the curved tank surface of the air tank, wherein the base of the housing is preloaded in flexion against the air tank to reduce vibrations between the air tank and the compressor unit.

7. The portable air compressor of claim 1, further comprising indicia including a symbol or image representative of a cord and/or a hose directing a user to wrap the power cord and/or a hose around the base.

8. The portable air compressor of claim 1, wherein the handle, the housing, and the base are formed from the same material.

9. The portable air compressor of claim 1, wherein the base is disposed radially outside of the bracket with respect to the axis.

10. The portable air compressor of claim 1, wherein the air tank includes a generally circular cross-sectional shape defining a central axis, wherein the compressor unit is coupled to the air tank such that the central axis intersects the compressor unit, and wherein the axis and the central axis are parallel or coincident.

11. A portable air compressor comprising:

an air tank configured to store compressed air;

a compressor unit securely coupled to the air tank by a bracket, the compressor unit in fluid communication with the air tank, the compressor unit including a housing having a concave recess extending at least partially around a circumference of the compressor unit, wherein the housing includes a base extending towards the air tank and engaging the air tank at a contact surface, the contact surface shaped to complement a surface of the air tank, wherein the contact surface is not fixedly secured to the air tank wherein the base is pre-loaded in flexion against the air tank, and, compressor components, including a motor and a compressor, for compressing air for storage in the air tank, the compressor components stored in the housing; and a power cord for supplying power to the compressor components, the power cord receivable around the circumference of the compressor unit in the recess for storage.

12. The portable air compressor of claim 11, wherein the air tank includes a support for supporting the portable air compressor on a surface, wherein the compressor unit is mounted on top of the air tank generally opposite the support of the air tank.

13. The portable air compressor of claim 11, wherein the base is formed from a polymeric material.

14. The portable air compressor of claim 11, further comprising cord indicia directing a user to wrap the power cord around the housing.

15. The portable air compressor of claim 11, wherein the recess is formed about the base of the housing.

16. The portable air compressor of claim 15, wherein the base includes a plurality of feet engaging, but not fixedly secured to, the air tank.

17. The portable air compressor of claim 15, wherein the air tank has a circular cross section defining a central axis, and wherein the concave recess defines a cord-wrapping axis generally parallel with the central axis such that the power cord is received around the central axis when stored in the recess.

18. The portable air compressor of claim 11, wherein the housing and the base are formed unitarily from the same material.

19. The portable air compressor of claim 11, wherein the housing includes a first side and a second side generally opposite the first side, wherein the base extends from the first side of the housing, the compressor unit further comprising a handle extending from the second side of the housing in a direction away from the air tank, wherein the housing defines an axis extending generally from the first side to the second side, and wherein the recess is disposed generally circumferentially around the axis.

20. A portable air compressor including an air tank having a curved tank surface for storing compressed air and compressor components including a motor and a compressor in fluid communication with the air tank for providing compressed air to the air tank, the portable air compressor comprising:

a bracket securing the compressor components to the air tank;

a housing configured to store the compressor components and engageable with the air tank, the housing including a flexible base having a contact surface engaging the air tank and shaped to complement the curved tank surface of the air tank, wherein the flexible base is pre-loaded in flexion against the air tank, and a recess formed about a circumference of the housing; and a power cord for supplying power to the compressor components, the power cord receivable in the recess for storage.

21. The portable air compressor of claim 20, wherein the flexible base extends from a first side of the housing, the portable air compressor further comprising a handle extending from a second side of the housing generally opposite the first side, in a direction generally opposite the flexible base, wherein the housing is formed as one piece with the handle and the base.

22. The portable air compressor of claim 20, wherein the base includes a plurality of feet.

23. The portable air compressor of claim 22, wherein the recess extends across each of the plurality of feet.

24. The portable air compressor of claim 20, wherein the base is formed from a polymeric material.

25. The portable air compressor of claim 20, further comprising cord indicia, including an image or symbol representing a cord, directing a user to wrap the power cord around the housing in the recess.

* * * * *